United States Patent [19]

Kumbera

[11] 3,955,167

[45] May 4, 1976

[54] ENCAPSULATED VACUUM FUSE ASSEMBLY

[75] Inventor: David G. Kumbera, Greendale, Wis.

[73] Assignee: McGraw-Edison Company, Elgin, Ill.

[22] Filed: Jan. 8, 1975

[21] Appl. No.: 539,419

[52] U.S. Cl. ..... 337/188; 337/414; 200/144 B

[51] Int. Cl.[2] ..... H01H 85/02

[58] Field of Search ..... 200/144 B; 337/158, 337/187, 188, 199, 273, 404, 405, 414

[56] References Cited

UNITED STATES PATENTS

| | | | |
|---|---|---|---|
| 2,706,742 | 4/1955 | Ehlers | 200/144 B |
| 2,785,319 | 3/1957 | Simpson et al. | 200/144 B |
| 3,244,839 | 4/1966 | Albright | 337/159 X |
| 3,781,745 | 12/1973 | Vadnagara | 337/199 |
| 3,806,680 | 4/1974 | Link | 200/144 B |
| 3,812,314 | 5/1974 | Nonken | 200/144 B |
| 3,818,407 | 6/1974 | Edgerton | 337/199 |

*Primary Examiner*—George Harris

[57] ABSTRACT

Fuse adapters are connected to the contact rods of a vacuum fuse. A rubber coating is provided over the entire outer surface of the vacuum fuse, but not over the fuse adapters. An epoxy body is molded over the coated fuse and the fuse adapters. Cavities are provided in the body to define wells, the fuse adapters being exposed in the wells to permit electrical connection to the fuse through the adapters.

7 Claims, 5 Drawing Figures

Fig. 1
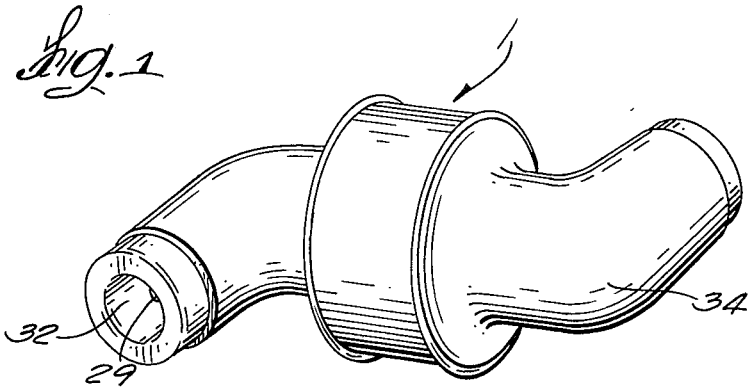
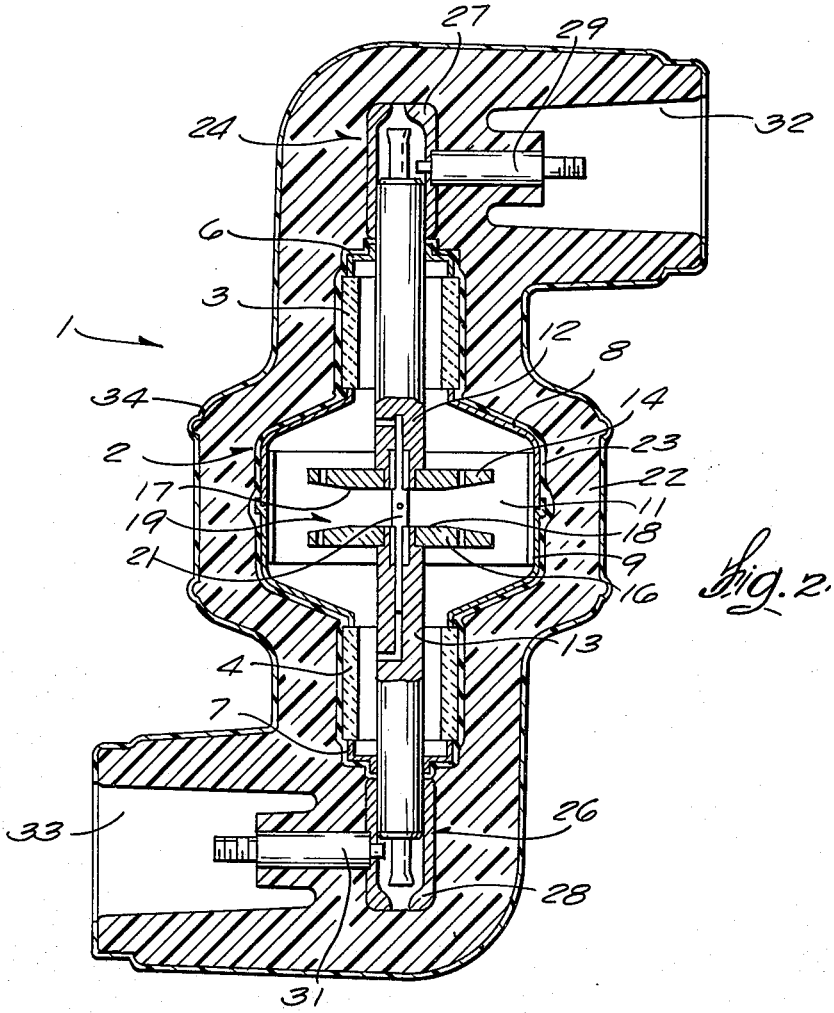
Fig. 2.

ENCAPSULATED VACUUM FUSE ASSEMBLY

BACKGROUND OF THE INVENTION

This invention relates to vacuum fuses and, more particularly, to a vacuum fuse encapsulated in a protective and support body made of electrical insulating material.

Electrical installations such as underground distribution systems have grown in popularity and also in size and complexity. With this growth has come an increased demand for sectionalizing equipment. Current limiting fuses, oil fuse cutouts, fused load interrupters and the like have been used but such equipment suffers from various drawbacks such as cost and limited current carrying and interrupting capacity. A co-pending application of Michael E. Arthur, Harvey W. Mikulecky and John W. Ranheim was concerned with these problems and proposed a vacuum fuse construction well suited to use in electrical installations of this type. That application is entitled "Vacuum Fuse", was filed on Apr. 25, 1974, received Ser. No. 464,103 and is assigned to the assignee of this application. The invention of this application is an extension of the fuse structure disclosed and claimed in that co-pending application but is not limited to use with that fuse structure.

SUMMARY OF THE INVENTION

In accordance with this invention, a vacuum fuse is encapsulated in a body of electrical insulating material, e.g. epoxy resin. The body provides electrical insulation of the vacuum fuse where that is desired and, in addition, provides structural support and protection for the vacuum fuse. Means is provided in the body through which electrical access to the vacuum fuse can be had for purposes of circuit connection. Preferably, fuse adapters are connected to the contact rods (or other terminals) and current exchange to the vacuum fuse is made through those adapters, the fuse adapters being exposed in the encapsulating body for circuit connection.

The major portion of the housing of the basic vacuum fuse is made from material which will expand and contract when exposed to temperature variations (e.g. metallic material such as copper-nickel, iron-nickel, cobalt or stainless steel) and, in use, the temperature of the vacuum fuse will vary due to self-generated heat. A thickness of flexible material, e.g. rubber, is coated over the exterior surface of the vacuum fuse prior to molding the encapsulating body onto the vacuum fuse. This material retains its flexible characteristics over the expected life of the fuse and accommodates expansion and contraction of the fuse housing due to temperature changes in minimize mechanical stressing of the vacuum fuse and/or the encapsulating body. Also, the encapsulating body is preferably molded onto the fuse and the flexible coating will accommodate any contraction of the body as it cures without stressing the fuse. The flexible coating is provided over the fuse but not over the mechanism through which electrical connection to the fuse is made, the fuse adapters where they are used.

A conductive or semi-conductive coating, e.g. semi-conducting epoxy or metallic material, is provided over the exterior of the encapsulating body. The coating provides a ground plane for the resulting fuse assembly and/or a system ground when connected in circuit.

Other objects and advantages will be pointed out in, or be apparent from, the specification and claims, as will obvious modification of the embodiments shown in the drawings, in which:

FIG. 1 is a perspective of an encapsulated fuse;

FIG. 2 is an axial section through the fuse and its encapsulating body;

DESCRIPTION OF THE PREFERRED EMBODIMENT

Figure 3:
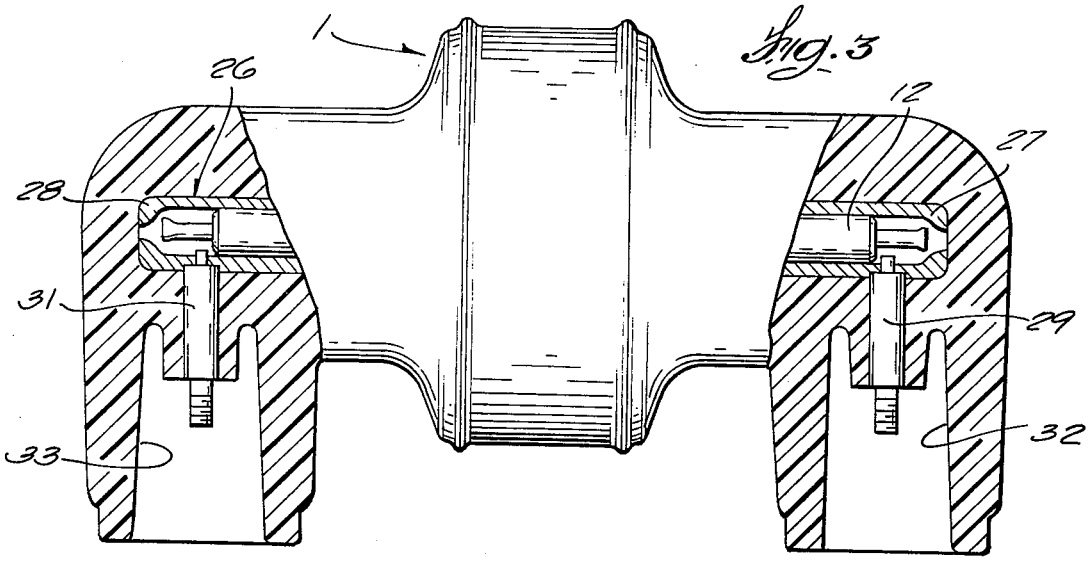
FIGS. 3–5 illustrate additional outer configurations of the encapsulated fuse.

FIG. 1 illustrates the exterior configuration of the encapsulated vacuum fuse 1 of this invention. The terminal arrangement through which the external electrical connections are made generally dictates the configuration of the fuse 1. As shown, the fuse is generally Z shaped but this invention is not limited to that configuration as will appear more completely hereinafter. The encapsulated fuse is circular through generally any transverse cross section taken along its length.

Reference will now be made to FIG. 2 for a more complete description of the vacuum fuse and the encapsulating body.

The vacuum fuse 2 depicted in FIG. 2 includes a housing made up of high voltage insulators 3 and 4, end caps 6 and 7, and bell-shaped housing members 8 and 9. The high voltage insulators are made of suitable electrical insulating material such as high alumina, forsterite, other ceramic materials, glass, or glass-ceramic. The end caps and bell-shaped housing members may be made of suitable metallic material compatible with the insulator materials so that the insulators are joinable to the end caps, e.g. copper-nickel, iron-nickel, cobalt or stainless steel.

This housing defines an interior area 11 in which elongated contact rods 12 and 13 and arcing electrodes 14 and 16 are located. The arcing electrodes are generally disk-shaped, defining parallel, confronting arcing surfaces 17 and 18 and a gap 19 therebetween. Fuse element 21 is electrically connected to the contact rods 12 and 13, as are disks 14 and 16, and extends between the rods bridging gap 19.

A vacuum condition is created in area 11 and during interruption, products of arcing are expelled outwardly from between disks 14 and 16. The fuse is a non-expulsion type and all products of interruption are confined within the fuse interior.

To complete the description of the general structure of fuse 1, contact rods 12 and 13 project outwardly from end caps 6 and 7. These projections of the contact rods provide the media through which electrical connection of the fuse can be made in the particular circuit to be protected.

Overall, fuse 1 is elongated having a longitudinal axis which coincides generally with the center or axis of contact rods 12 and 13.

The vacuum fuse 2 being of the non-expulsion type and having the generally elongated overall configuration, lends itself well to an encapsulated device. By encapsulating the vacuum fuse, basic structural support is provided for the fuse per se, the fuse is protected from structural damage by the encapsulating body, and inherent electrical insulation of the vacuum fuse is provided. Moreover, the generally elongated configuration of the vacuum fuse permits of a variety of configurations of the final encapsulated vacuum fuse assembly as will be discussed more completely hereinafter.

With particular reference to FIG. 2, body 22 completely surrounds vacuum fuse 2. Preferably, encapsulation is accomplished by molding the body over the vacuum fuse assembly. The vacuum fuse assembly is supported in a suitable mold structure and the body material is injected into the mold and is caused to closely engage over the outer surface of the vacuum fuse. The material of the body should have electrical insulating properties, epoxy resin material for the body has provided satisfactory results as has rubber.

In field use, the fuse assembly will be exposed to wide variations in temperature due to self-generated heat. For example, the fuse may be exposed to prolonged high current conditions but below a fault condition which the fuse is intended to interrupt and clear. This will raise the temperature of the fuse structure. The outer housing of the fuse being basically of a metallic material is therefore subject to expansion and contraction due to these variations in temperature. Being embedded in body 22 and being in close intimate engagement with the body, this expansion and contraction could stress the outer fuse housing with attendant detrimental results. In order to maintain the structural and electrical integrity of the overall encapsulated fuse assembly, a generally void free engagement between the fuse and the body is desired. This is accomplished while still accommodating the expansion and contraction just discussed by providing a coating 23 of flexible material, e.g. rubber, over the outer surface of vacuum fuse 2. This flexible coating is provided on the vacuum fuse assembly before that assembly is molded into body 22. Thus, the molded material can intimately engage with the flexible coating and through it the overall vacuum fuse assembly providing a generally void free interface between the vacuum fuse assembly and the body. An added advantage of the flexible material is that any tendency of the encapsulating body 22 to contract as it cures after molding will also be accommodated in the flexible coating.

A further problem encountered in encapsulating the vacuum fuse is the manner in which the external circuit connections are made to the vacuum fuse after encapsulation. This is accomplished by providing fuse adapters 24 and 26 which are mechanically and electrically connected to the terminals (contact rods 12 and 13, respectively) of the vacuum fuse and are accessible from the exterior of the encapsulated fuse assembly.

More particularly, the fuse adapters include tubular portions 27 and 28 which fit over the exposed ends of contact rods 12 and 13. These tubular portions are electrically connected to the contact rods and carry terminal portions 29 and 31, respectively. These terminal portions project into openings provided in body 22 where they are accessible from the encapsulated fuse ambient. More particularly, cavities 32 and 33 are molded in the encapsulating body and provide wells into which terminal portions 29 and 31 project. The wells so provided are conventional bushing wells to accept an electrical bushing assembly or other external connectors as desired.

The flexible coating 23 is provided over the outer surface of vacuum fuse 2 but terminates short of fuse adapters 24 and 26.

In assembly, fuse adapters 24 and 26 are connected onto the exposed ends of contact rods 12 and 13. Flexible coating 23 is applied over the outer surface of the fuse assembly 2, terminating short of and not extending over either of the fuse adapters 24 or 26. The assembly to that point is inserted in a suitable mold and the epoxy material, or other insulating material, is injected into the mold to provide the configuration desired for the encapsulating body.

Figure 4:
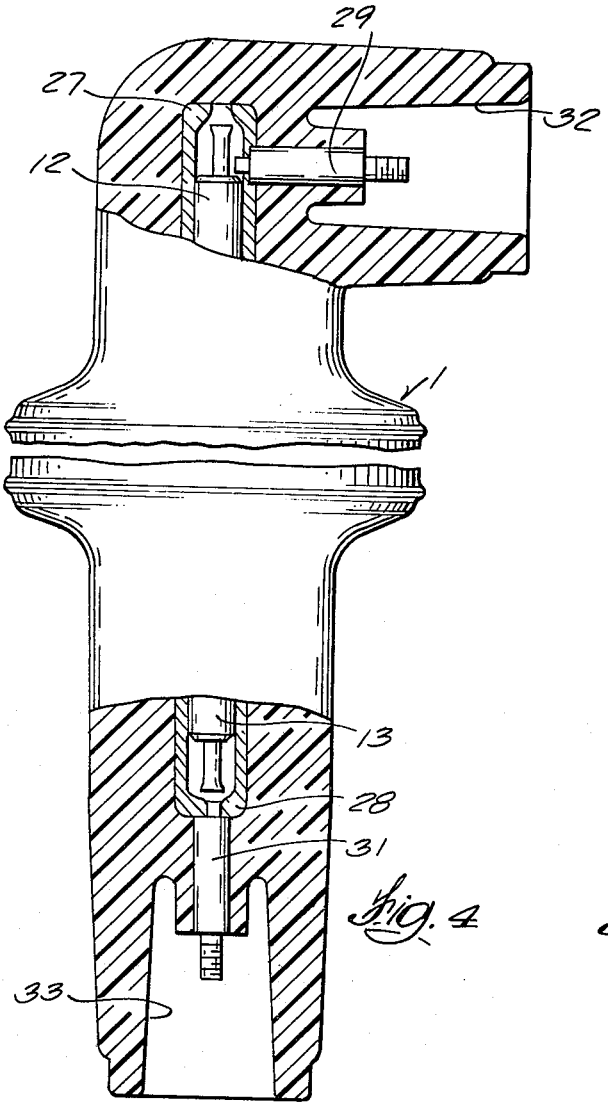
Figure 5:
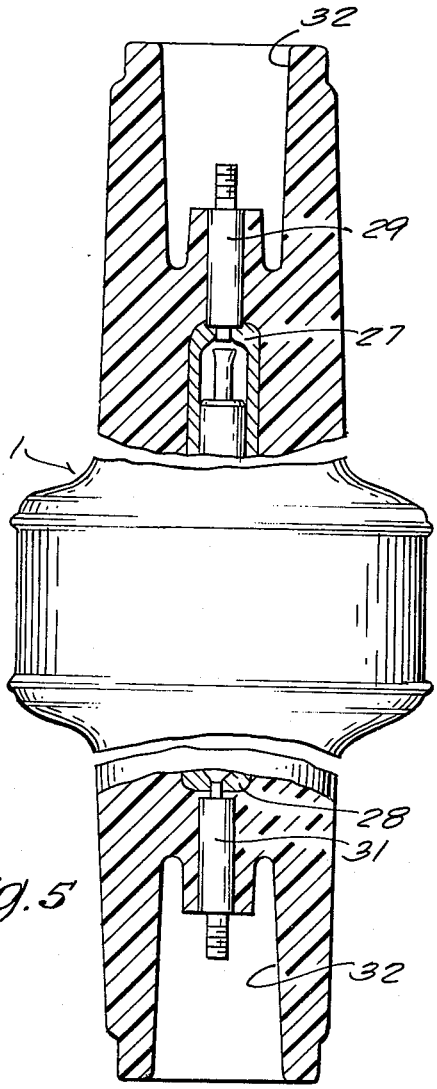

The basic elongated configuration of the vacuum fuse, together with the fuse adapters 24 and 26 which fit onto the exposed portions of the contact rods provide an overall vacuum fuse arrangement which lends itself to a variety of final configurations for the encapsulated vacuum fuse assembly without major modification to any of the basic elements. Examples of additional configurations are illustrated in FIGS. 3, 4, and 5. For convenience, the interior structure of the fuse is not illustrated but only the terminations. The interior remains the same for all embodiments.

As can be seen, the same generally basic fuse adapters are used with the same vacuum fuse assembly to provide a U-shaped encapsulated fuse as seen in FIG. 3, an L-shaped encapsulated fuse as illustrated in FIG. 4, and an I-shaped vacuum fuse as illustrated in FIG. 5. The only structural change between the four illustrated configurations (Z, U, L, and I) is that the terminal portions of the fuse adapters in some instances are connected through the axially aligned outer openings in the fuse adapter and are co-axial with and axially aligned on the longitudinal axis of the vacuum fuse. In other instances the terminal portions 29 extend at right angles to the longitudinal axis.

A further advantage in the use of the fuse adapters is that they provide a smooth terminal transition to the contact rods of the vacuum fuse thereby preventing corona which, should it occur, could be extremely harmful to the insulating body 22. Moreover, the fuse adapters standardize the connection to permit use with standard external circuit connectors.

The encapsulating body provides overall basic support for the vacuum fuse and protects the fuse from damage due to mishandling between factory assembly and field installation. This insures the structural integrity of the device as it is controlled at the factory. Moreover, the encapsulating body protects the fuse in the field from ambient conditions, be it the weather conditions or a controlled environment within a particular electrical apparatus such as an oil or gas filled unit in which the encapsulated fuse may be placed. All these desirable features are accomplished in a basic unit which can provide a variety of outer configurations so as to increase the versatility of the overall concept.

It is also desirable to coat the exterior of the encapsulating body with a semi-conducting material 34. This semi-conducting material provides an electrical ground plane over the exterior of the encapsulated fuse which can, in some installations, establish a uniform electrical grading of the overall device. Additionally, the coating can provide a system ground when used with external circuit connectors such as underground cable connectors. This material may be an epoxy resin impregnated with a suitable conductive material or can be a suitable metallic material.

Although this invention has been illustrated and described in connection with particular embodiments thereof, it will be apparent to those skilled in the art that various changes and modifications may be made therein without departing from the spirit of the invention or from the scope of the appended claims.

I claim:

1. An encapsulated vacuum fuse assembly comprising, in combination, a body of electrical insulating material, a vacuum fuse including a housing and a fuse element in said housing, said vacuum fuse embedded in said body and also including first and second spaced terminal means for connecting said fuse element in an electrical circuit, said body having generally close engagement over the outer surface of said vacuum fuse, a coating of flexible material extending over the housing of said vacuum fuse, said coating in intimate engagement with said body and accomodating relative expansion and contraction movement between said vacuum fuse housing and said body due to temperature variations to thereby maintain generally void free engagement therebetween, and means in said body for providing conductive access to said terminal means for making electrical connections thereto and including fuse adapter means electrically and mechanically connected to said vacuum fuse terminal means and through which current exchange to said vacuum fuse is made, means defining first and second openings in said body open to the fuse assembly ambient, and said fuse adapter means projecting into said openings for accepting external circuit connections.

2. The encapsulated vacuum fuse assembly of claim 1 wherein said body is made of an epoxy material.

3. The vacuum fuse assembly of claim 1 wherein said first and second openings are in the form of cavities in said body providing wells for receipt of said external circuit connections, and said fuse adapter means project into a respective one of said wells.

4. The vacuum fuse assembly of claim 1 wherein said vacuum fuse is generally elongated having a longitudinal axis and includes axially aligned, relatively spaced contact rods projecting from the opposite axial ends of said vacuum fuse housing to provide said first and second terminal means, said fuse adapter means includes generally tubular portions fitting over and electrically and mechanically connected to each of said contact rods and terminal portions electrically connected to tubular portions, and said fuse adapter means terminal portions projects from said tubular portions into said openings for accepting external circuit connections.

5. The vacuum fuse assembly of claim 4 wherein said first and second openings are in the form of cavities in said body providing wells for receipt of said external circuit connections, and said terminal portions of said fuse adapters means project into a respective one of said wells.

6. The vacuum fuse assembly of claim 4 including a coating of semi-conductive material extending over the outer surface of said body.

7. The vacuum fuse assembly of claim 4 wherein said tubular portion of said adapter means includes connecting means for establishing said connection to said terminal portion in at least one of an axially aligned relationship of said tubular and said terminal means, or in an angular relationship of said tubular and said terminal means.

* * * * *